US006039056A

United States Patent [19]

Verbeek

[11] Patent Number: 6,039,056

[45] Date of Patent: Mar. 21, 2000

[54] COMPUTER CONTROLLED APPARATUS AND METHOD FOR THE CLEANING OF TANKS

[76] Inventor: Diederik Geert Verbeek, Pootstraat 94, Delft, Netherlands, 2613 PN

[21] Appl. No.: 09/155,685

[22] PCT Filed: Apr. 2, 1997

[86] PCT No.: PCT/NL97/00165

§ 371 Date: Oct. 2, 1998

§ 102(e) Date: Oct. 2, 1998

[87] PCT Pub. No.: WO97/36697

PCT Pub. Date: Oct. 9, 1997

[30] Foreign Application Priority Data

Apr. 3, 1996 [NL] Netherlands ..... 1002773

[51] Int. Cl.[7] ..... B08B 3/02; B08B 9/12

[52] U.S. Cl. ..... 134/22.18; 134/167 R; 239/227

[58] Field of Search ..... 134/22.18, 167 R, 134/168 R; 239/227

[56] References Cited

U.S. PATENT DOCUMENTS

| | | | |
|---|---|---|---|
| 1,557,240 | 10/1925 | Butterworth | 239/227 |
| 1,657,990 | 1/1928 | Blouin | 239/227 |
| 3,001,534 | 9/1961 | Grant . | |
| 3,255,970 | 6/1966 | Saad | 239/227 |
| 3,416,732 | 12/1968 | Reiter | 239/227 |
| 3,556,407 | 1/1971 | Niikura et al. | 239/227 |
| 3,711,026 | 1/1973 | Heinrich et al. | 239/227 |
| 3,874,594 | 4/1975 | Hatley | 134/167 R X |
| 3,895,756 | 7/1975 | Jaeger | 134/167 R X |
| 5,172,710 | 12/1992 | Harrington | 134/167 R |
| 5,279,675 | 1/1994 | Verbeek | 134/167 R X |
| 5,482,063 | 1/1996 | Miura et al. | 134/167 R X |
| 5,715,852 | 2/1998 | Jepsen | 134/167 R |

FOREIGN PATENT DOCUMENTS

| | | | |
|---|---|---|---|
| 0 027 007 | 4/1981 | European Pat. Off. . | |
| 2318109 | 11/1973 | Germany | 134/167 R |

*Primary Examiner*—Philip R. Coe
*Attorney, Agent, or Firm*—Roberts & Mercanti, LLP

[57] ABSTRACT

The invention relates to machines for cleaning the inner surfaces of all kinds of tanks. The cleaning is processed by means of a nozzle (14) spraying a jet of cleaning fluid against the surface to be cleaned. Each nozzle (14) is rotatable around two axes, that enclose an angle. In order to be able to customize the working procedures of the machine to the geometry and size of the tank and to the kind of pollution, the machine comprises an electronic control and two independently operating drives (4) by means of which the rotational movement of the nozzle (14) around the two axes can be controlled.

21 Claims, 15 Drawing Sheets

COMPUTER CONTROLLED APPARATUS AND METHOD FOR THE CLEANING OF TANKS

FIELD OF THE INVENTION

The invention relates to machines for the inner cleaning of all kinds of hygienic rooms, whet rooms, fermenters, reactors, containers or all kinds of tanks meant for manufacturing, transport or storage of all kinds of goods such as nutritions, beverages, chemicals or oil products. The cleaning is performed by means of at least one nozzle spraying a jet of cleaning liquid against the inner surfaces. The movement of the nozzle is such that the impingement point of the jet systematically covers all the surfaces to be cleaned, by means of which method all the contamination is removed.

The aim of the invention is to optimize the cleaning process as much as possible, meaning that a more thorough cleaning is done in a much shorter time, using a much lower amount of energy and washing water.

BACKGROUND OF THE INVENTION

Numerous publications of tank washing machines already exist. Usually these machines rotate homogeneously about a vertical axis, whilst the nozzles making homogeneous or oscillating movements about a horizontal axis. Mostly the machines are driven by a turbine or a motor. The movement pattern of the nozzles is determined by a set of mechanical parts. A serious disadvantage is these machines are spreading the cleaning fluid in all directions with approximately the same intensity. The furthest places being jetted under the sharpest impingement angle receive relatively the smallest amount of washing water. Sometimes it is necessary to give special attention to places with a more rigid kind of contamination, such as the rim of burn-yeast in brewery tanks. The bottle-neck in the cleaning of the tank depends on the places receiving the smallest amount of washing water and having the most rigid kind of pollution. Most of its operational time conventional machines are spraying washing water to places that were already cleaned.

In many cases sanitation first needs spreading of a concentrated cleaning or disinfection agent. After a certain soaking time this agent and the contamination can be removed using fresh water. Usually in these cases the room is cleaned manually. In principle the existing tank washing machines are capable of spreading these agents, in practice, however, the high flow rates and the long time necessary to reach a complete coverage result in needed quantities of cleaning agent being so high, that their use is normally not economical.

SUMMARY OF THE INVENTION

The invention exists of an apparatus (robot) and a method of working followed accurately by the robot. Only by the combination of machine and method it is possible to obtain the optimum cleaning result.

In essence the robot has two independently controlled drives, which makes that the rotations about the two axes are no longer mechanically coupled, but can be considered as robotic degrees of freedom. By customizing data processed by a computer program, the movement of the jet can be steered into any direction and, within certain limits, be controlled at any desired speed.

The method of the invention defines in what way the nozzle should be steered in order to obtain the optimum cleaning result. The method consists of a number of rules, leading to different washing patterns, depending on size and shape of the surfaces to be cleaned. A distinction is made between the case where a cleaning agent is being distributed over the surface and the case where the pollution is being washed away. Since the robot is capable of performing both tasks in the shortest possible time, the invention is an alternative for the conventional tank washing machines as well as for the manual cleaning method.

The invention intends the rotational movements, about a horizontal axis and about a vertical axis of one or more nozzles, to be determined by flexible electronic information in a computer program instead of by mechanical parts. The robot can be embodied in different ways, all characterized by an electronic control of jetting direction. A characterization is that the driving of the one or several nozzles involves two, preferably concentric, bar or tube shaped rotation elements, being part of a transmission, that converts in a mechanical way the movements of the motors or actuators into a movement of each of the nozzles.

BRIEF DESCRIPTION OF THE DRAWINGS

Three embodiment examples of the robot and the principles of the method will be described with reference to the accompanying drawings, in which.

DEFINITION OF SYMBOLS

For the explanation of the method several parameters are being used. The following symbols stand for the following meanings:

- V the transversal speed of the impingement point of the jet over the surface to be cleaned.
- $V_0$ an empirical constant
- L the density of the trajectories, expressed in the perpendicular distance between two more or less parallel traverses of the impingement point of the jet.
- B the broadness of the cleaned area after traversing the impingement point with speed V
- $B_0$ an empirical constant.
- I the cleaning intensity.
- $I_{conv}$ the cleaning intensity of a conventional homogeneously rotating machine.
- $I_{min}$ the minimum value of $I_{conv}$
- $I_{robot}$ the cleaning intensity of the invention
- R the distance of the nozzle to the target area on the surface being cleaned
- $\alpha$ the impingement angle between the jet and the surface being cleaned
- $\beta$ the transverse direction angle, originating in the jets impingement point, corresponding to the smallest angle with the perpendicular projection line of the oblique impinging jet onto the target plane.
- $\eta$ the cleaning efficiency, i.e. necessary cleaning time with the invention divided by necessary cleaning time with a conventional machine.
- $\theta$ the angle between jetting direction and the horizontal plane

DETAILED DESCRIPTION OF THE PREFERRED EMBODIMENTS

First a description will be given of the embodiment of the robot invention. Second an extensive description will be given of the movements made by the robot necessary to obtain the most optimum cleaning result.

Figure 1:
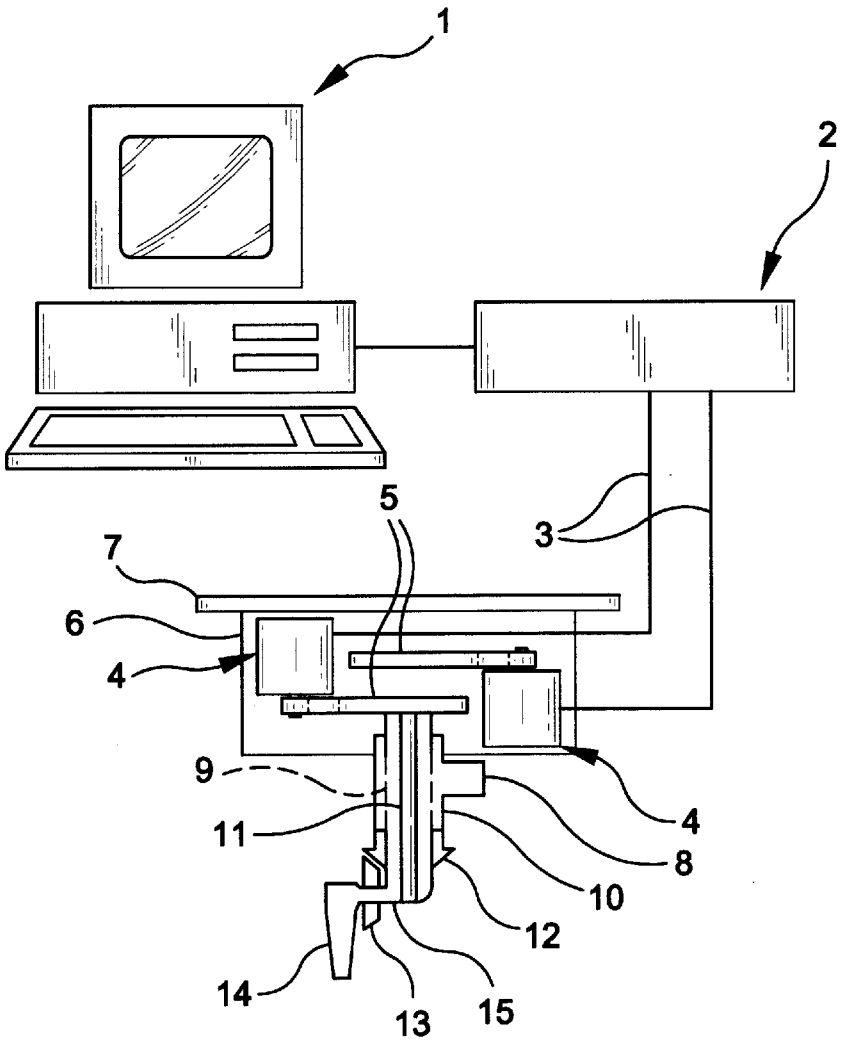
FIG. 1 shows a vertical section of the robot suitable for the cleaning of hygienic working rooms.
Figure 2:
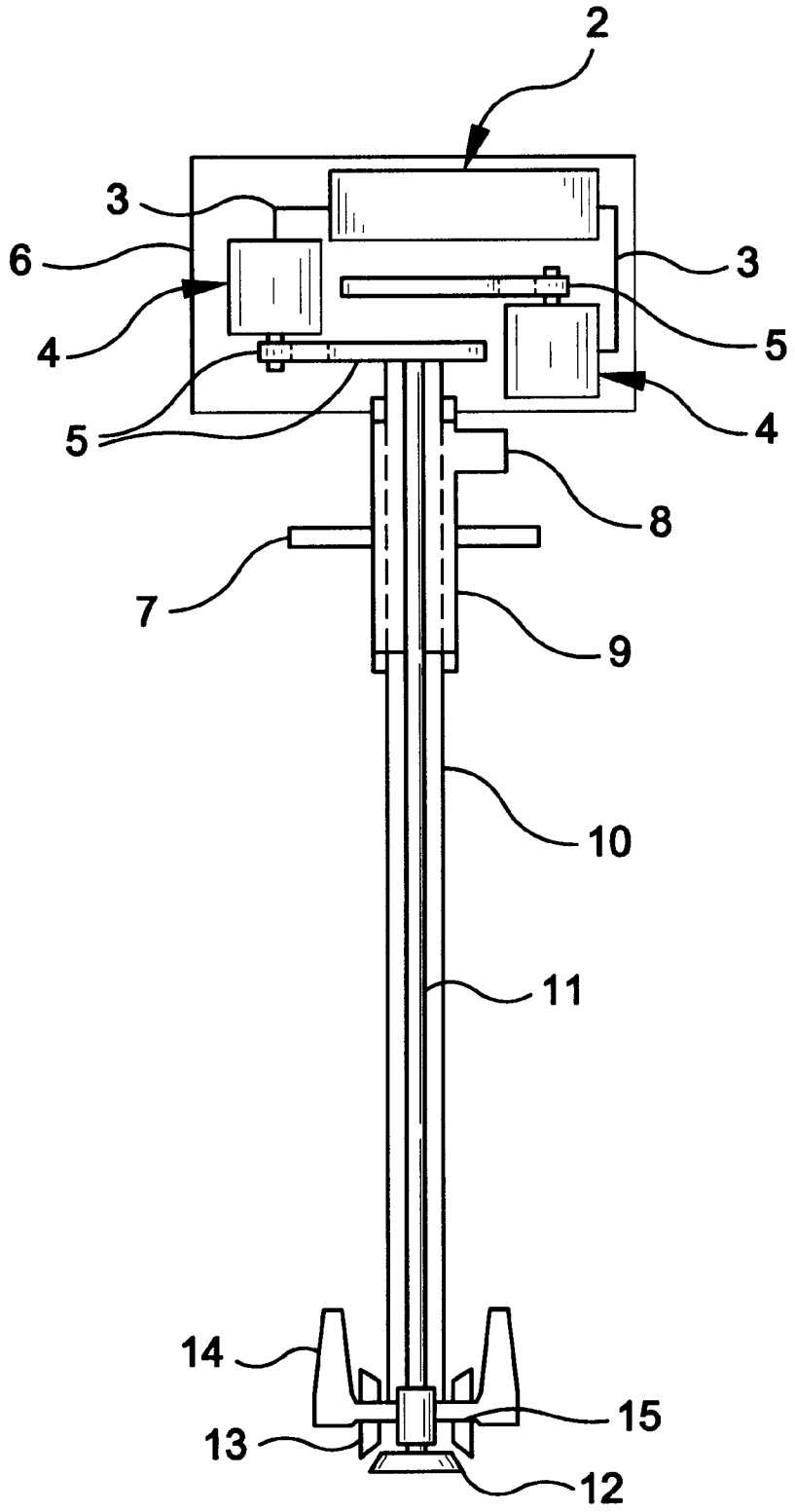
FIG. 2 shows a vertical section of the robot suitable for the cleaning of a tank.

The design drawings FIG. 1 and FIG. 2 are intentionally simplified in order to explain more clearly the robot's working principle, which is the same for the two examples. Equal numbering means that it is the same particle or a particle with the same functionality.

A computer 1 runs the various steering programs and serves as human interface. The computer gives signals to the steering/power electronics 2, which on its turn uses the wiring 3 to power the stepping or servo motors 4. Since the steering electronics is capable of working stand alone, the computer is necessary at the installation of the robot for calculating the optimized steering coordinates and may be replaced by a start button in a later stage. The machine of FIG. 2 shows no separate computer and the steering electronics is housed in the drive section part of the machine.

By means of a gear wheel/gear belt drive the forces of the motors are transmitted onto the "lead through" part of the machine. The housing of the drive section 6, the mounting plate 7, the supply pipe for the washing liquid 8, and the support pipe 9 form one entity. In FIG. 1 the mounting plate 7 is designed in such a way that the machine is suitable for hanging on the ceiling of a room. In FIG. 2 the design of the mounting plate leaves the drive section of the machine outside the tank, whilst the lower part of the machine and of the support pipe 9 sticks through a hole into the tank.

Support pipe 9 may have any arbitrary length smaller than the length of pipe 10 and serves only for the rigidity of the machine and for the mounting of bearings and seals (not shown). Within the length covered by pipe 9 pipe 10 needs holes to let the washing fluid from the outside in. The fluid streams through pipe 10 to the head 15 and leaves the machine through nozzle 14 as a jet. Pipe 10 and pipe 11 are both independently rotatable about their length axes. Rotation angle and rotation speed of each of these is driven by one of the motors 4.

The head 15 of the machine is shown as a side pipe. The bevel gear 13 and the nozzle 14 are one entity, which is rotatable around this side pipe. The bevel gears 12 and 13 form a transmission, which is preferably 1:1. Any other ratio implies the need of additional mechanical or electronic elements for enabling the machine to find its starting position in a univocal way after powering-up. In FIG. 1 head 15 is mounted onto bar 11 and gear 12 is mounted onto pipe 10. In FIG. 2 head 15 is mounted onto pipe 10 and gear 12 onto bar 11. The working principle is in both cases exactly the same. The horizontal jetting direction is determined by the rotation of the head and is directly driven by one of the motors. The vertical jetting direction is determined by the difference in rotation of the head and gear 12, which is driven by the difference in rotation angle of the two motors 4. Both of the motors perform a complex series of rotational movements, resulting in a systematic way for the liquid jet from the nozzle to clean all of the dirty surfaces.

In the embodiment of FIG. 2 two nozzles with accompanying bevel gears are drawn. The second set makes essentially the same movement as the first, differing in the fact that the jetting direction is rotated over 180° about the vertical body axis. The advantage is that no bending reaction force will be exerted onto pipes 10 and 11, and that each of the nozzles only needs to clean half of the tank. A provision is that the tank is symmetrical with respect to the machines position, or else the cleaning efficiency decreases.

Figure 3:
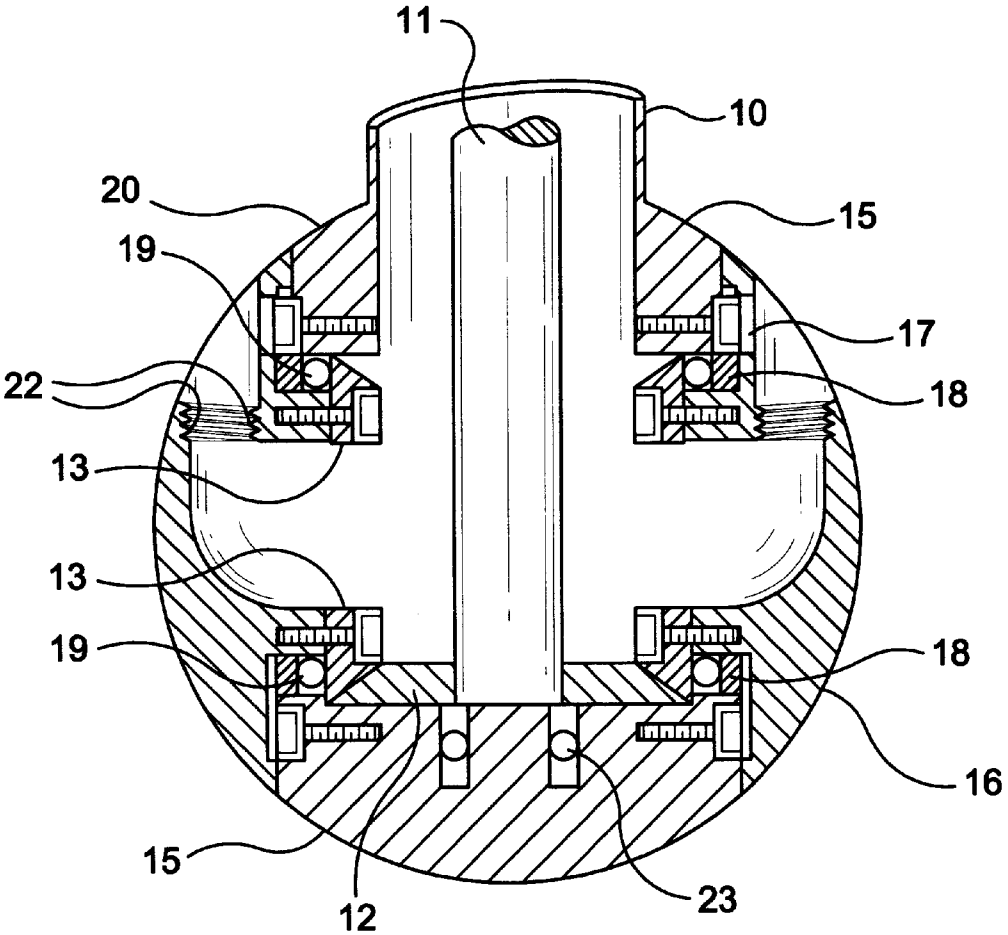
FIG. 3 shows a detailed section of the nozzle head part of the robot.
Figure 4:
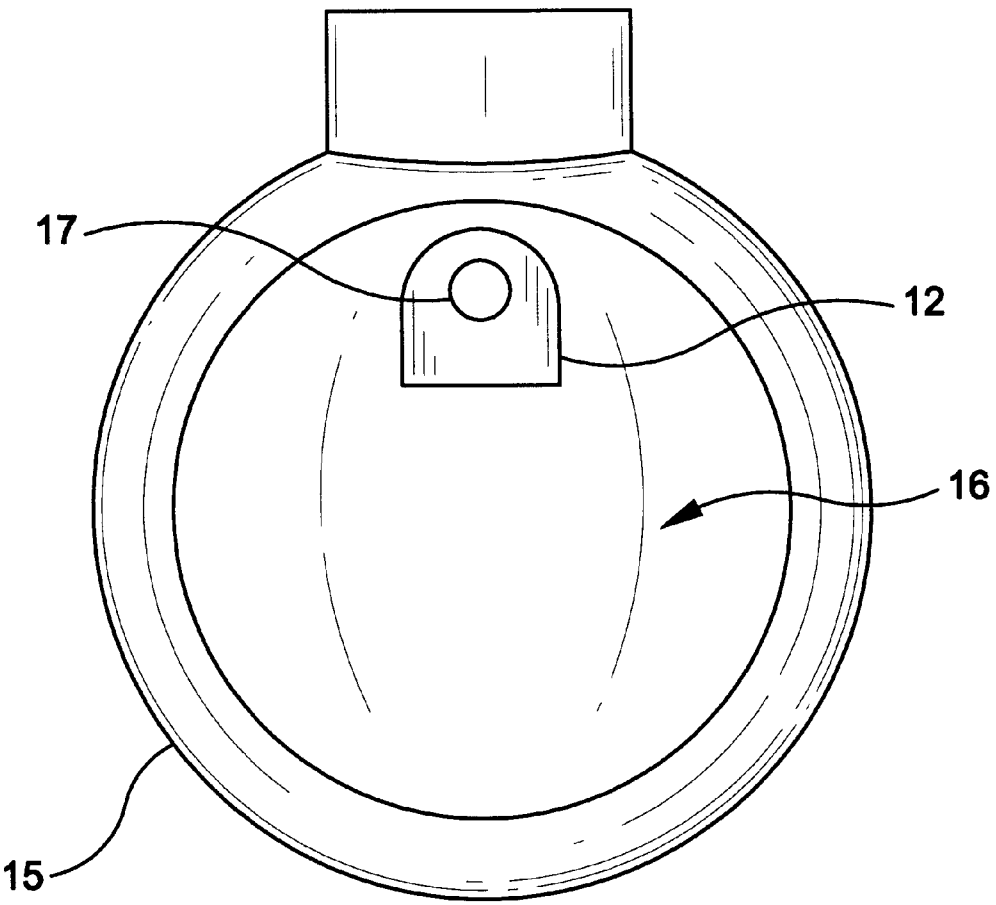
FIG. 4 shows a side elevational view of the head part of the robot.

FIG. 3 shows in example a more detailed version of the head part of the robot. FIG. 4 shows the same part in side elevational view. Since in most cases the head will be submerged in the tanks cargo and since the jets can be aimed at all of the tanks interior surfaces except the head itself, the machine may be a potential source of contamination or product fouling. In order to obtain the best possible self cleaning properties, the basic shape of the head is spherical. This way the fluid film running down will cover the entire outside of the head. For much the same reason no liquid seal is needed between the head 15 and the segments 16, which induces an intentional leakage through the bearings. Further the machine is constructed in such a way that it drains itself completely after use.

The machine's vertical body-axis is common with the cylinder axes of pipe 10 and bar 11. In FIG. 3 The head 15 is connected to the pipe 10, which makes a controlled movement about this body-axis. The segments 16 are rotatable by means of bearings 19 about a horizontal axis through the centre of the head. The fluid pressure pushes the segments out. The segments are kept in place by gear wheel 13 and ring 18, who also serve as path keeper for the balls of the bearing. Ring and gear are kept in place by means of socket head screws. In order to be able to tighten the screws a hole 17 is drilled in segments 16. A cut-away 21 and a thread 22 in the segments 16 is for fixing the nozzles.

The rotation of the segments is controlled by the 1:1 bevel gear transmission 12/13. Gear 12 is connected to bar 11. Bar 11 is kept centred by bearing 23. The difference in rotation between pipe 10 and bar 11 determines the rotation of the segments 16 about the horizontal axis through the heart of the head.

Figure 16:
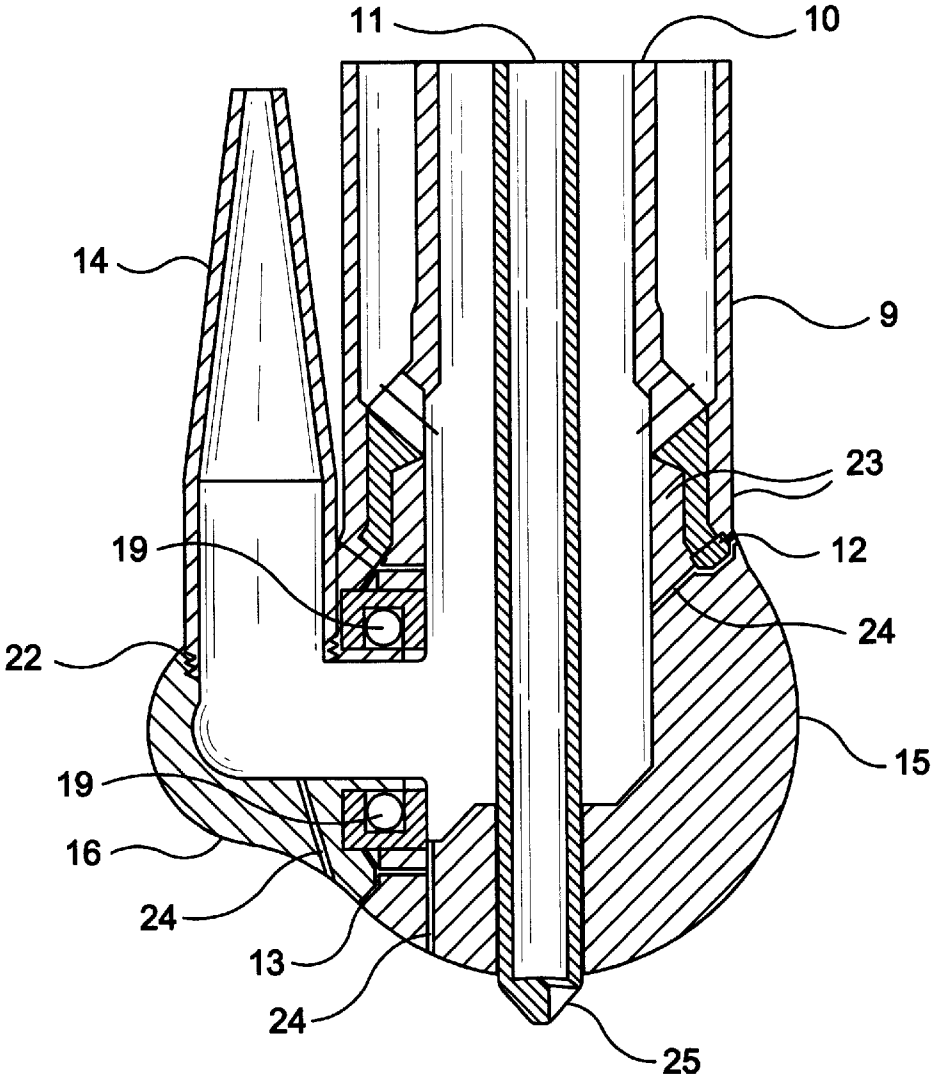
FIG. 16 shows a detailed section of the nozzle head part of the robot in an embodiment according to FIG. 1.
Figure 17:
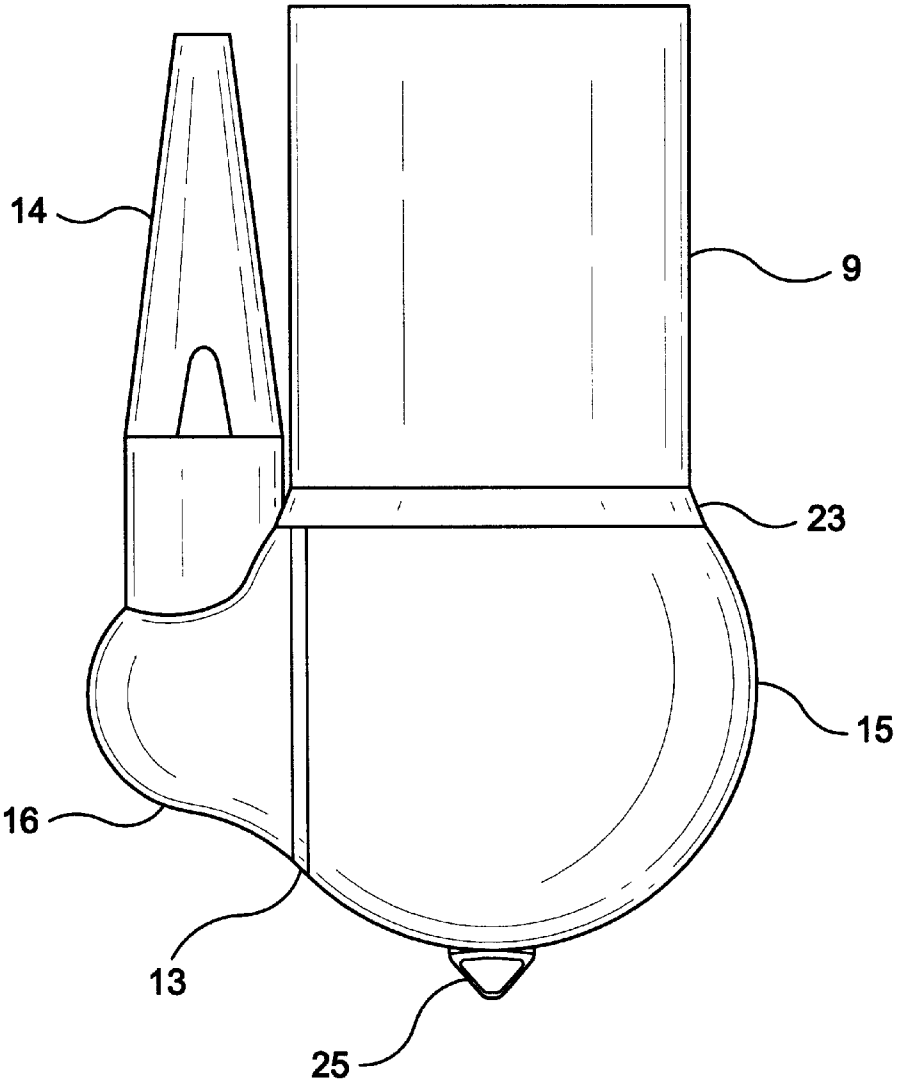
FIG. 17 shows a perspective view of the nozzle head part of the robot in an embodiment according to FIG. 1.

FIG. 16 and FIG. 17 show a different embodiment of the robot according to the principle sketched in FIG. 1. FIG. 16 shows a section and FIG. 17 shows a perspective view of the head part of this embodiment. The numbers of the parts in the figure comply to the numbers in the FIGS. 1 through 4. Equal numbers denote equal or comparable parts. The difference with the embodiment in FIGS. 3 and 4 is, that in this embodiment the rotation of the head 15 about the vertical axis is determined by the rotation of bar 11 instead of by tube 10. The difference in rotation between bar 11 and tube 10 still determines the rotation of the nozzle about the horizontal axis. In order to improve the self-cleaning properties of the machine, holes, 24, have been drilled in a number of parts. The water jet originating from these holes clean the exterior of the head. The cap nut, 25, serves as fixation of the head onto the bar. For the fixation of bearing 19 onto the head 15 and for the fixation of the segment 16 onto the bearing, the bearing is threaded on the inside and on the outside.

Figure 18:
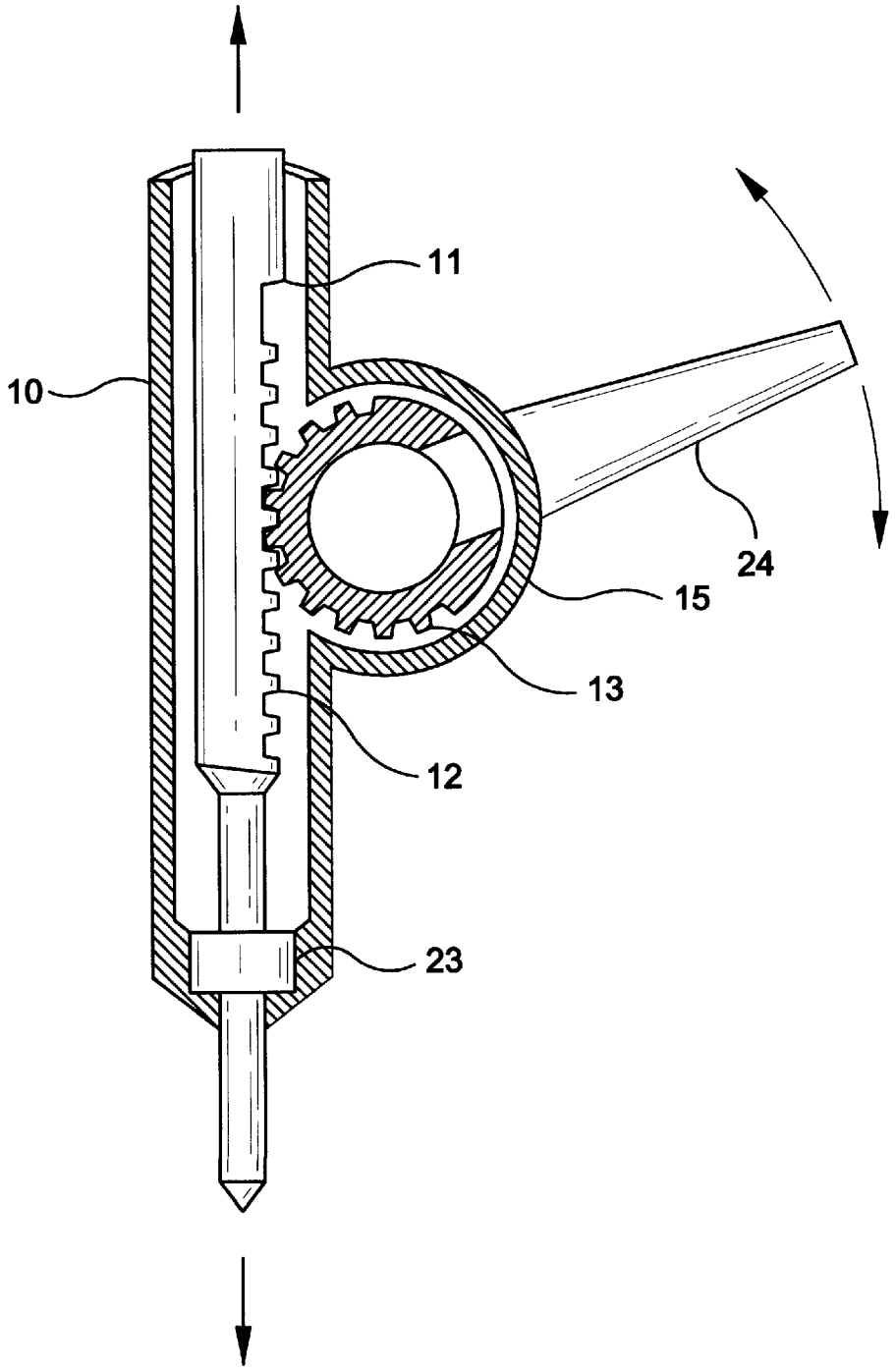
FIG. 18 shows a detailed section of the nozzle head part of the robot in an embodiment where the rotational movement of the nozzle, or nozzles, about the horizontal axis is driven by the vertical displacement of the tube or bar-shaped elements with respect to each other.

The embodiment shown in FIG. 18 deviates from the examples shown in FIGS. 1, 2, 3, 4, 16 and 17. The difference is that the rotation of the nozzle about the horizontal axis is not determined by a rotational difference of elements 10 and 11, but by a translational difference of the two elements along their common vertical axis. Part 12, being a bevel-gear in the previous examples, is a cog-rail in this example. The bearing element 23 still serves for centering the elements 10 and 11 with respect to each other. Yet instead of being a rotational bearing element, it is now a translational sliding element. The driving of the two elements 10 and 11 by the two motors or actuators is best done in such a way, that one of the motors or actuators drives the rotational movement of tube element 10, and the other drives the vertical movement of the bar shaped element 11. This way the rotational movement of the nozzle about the horizontal axis is determined by just one of the motors or actuators instead of by the difference of the two. The disadvantage is that extra sensors will be needed for determining the end positions of bar 11.

All the embodiments have in common, that one of the tube or bar shaped elements determines the rotational movement of each of the nozzles about the vertical body axis of the machine, and that the rotational or translational difference between the two elements determines the rotation of the each of the nozzles about a horizontal axis, which itself follows the first rotational movement about the vertical body-axis. The new aspect in the invention is the use of independently controllable drives that enable the steering of each nozzle into any desired direction. The purpose of the invention is, to steer the jets of cleaning fluid in such a way that the room, where the machine is installed, will be cleaned out in the most effective and systematic way. Consequently it is unimportant what embodiment is used, since in the end the cleaning result is only determined by the steering method of the jetting direction.

Next a description will be given of the cleaning method that enables the robot to clean any kind of room or tank in the most efficient way.

The machine steers the spraying direction of the jet from one fixed location in such a way that the jet's impingement point passes by the entire dirty surface in a systematic way. The steering program contains information about geometry, size, location and orientation of all of the surfaces to be cleaned. The complexity of the performed steering sequence depends on the geometric complexity of the space to be cleaned. Although the program accounts for the machine's own location in the tank, the machine is best situated in such a way that all dirty surfaces can be reached by the jet. If this is not possible a solution should be found using more than one robot, where each of them is responsible for a certain part of the room. Further each of the machines is preferably situated in such a way that the dirt is splashed into the desired direction of the drain well. Usually this means a situation closely under the roof, but not too close since otherwise the ballistically curved shape of the jet may not be able to reach the furthest corner.

The invention's method accounts for a large number of effects that may have more or less influence on the cleaning process. This results in a number of rules and recommendations for routing, speed and density of the trajectory followed by the jet over the surfaces to be cleaned. They all aim at the highest possible cleaning efficiency, i.e. a minimisation of the cleaning costs. Albeit that the invention's method will be described as the behaviour of the jet's impingement point, it has to be considered that a computer program translates the desired behaviour into the corresponding steering coordinates of the motors of the robot, which on its turn depends on the machine's location, the geometry of the room and the objects in it. Usually the steering coordinates will have been calculated on a fast computer and will have been saved in a file in advance of the washing process. This eases the demand of the controlling computer and simplifies the running program to a simple feeding algorithm. In case the desired behaviour of the robot also needs the implication of ever changing parameters such as the tank's previous fill-up level or product (dirt) type, the steering coordinates may be calculated real-time on the controlling computer, which in that case needs to be much more powerful.

Figure 5:
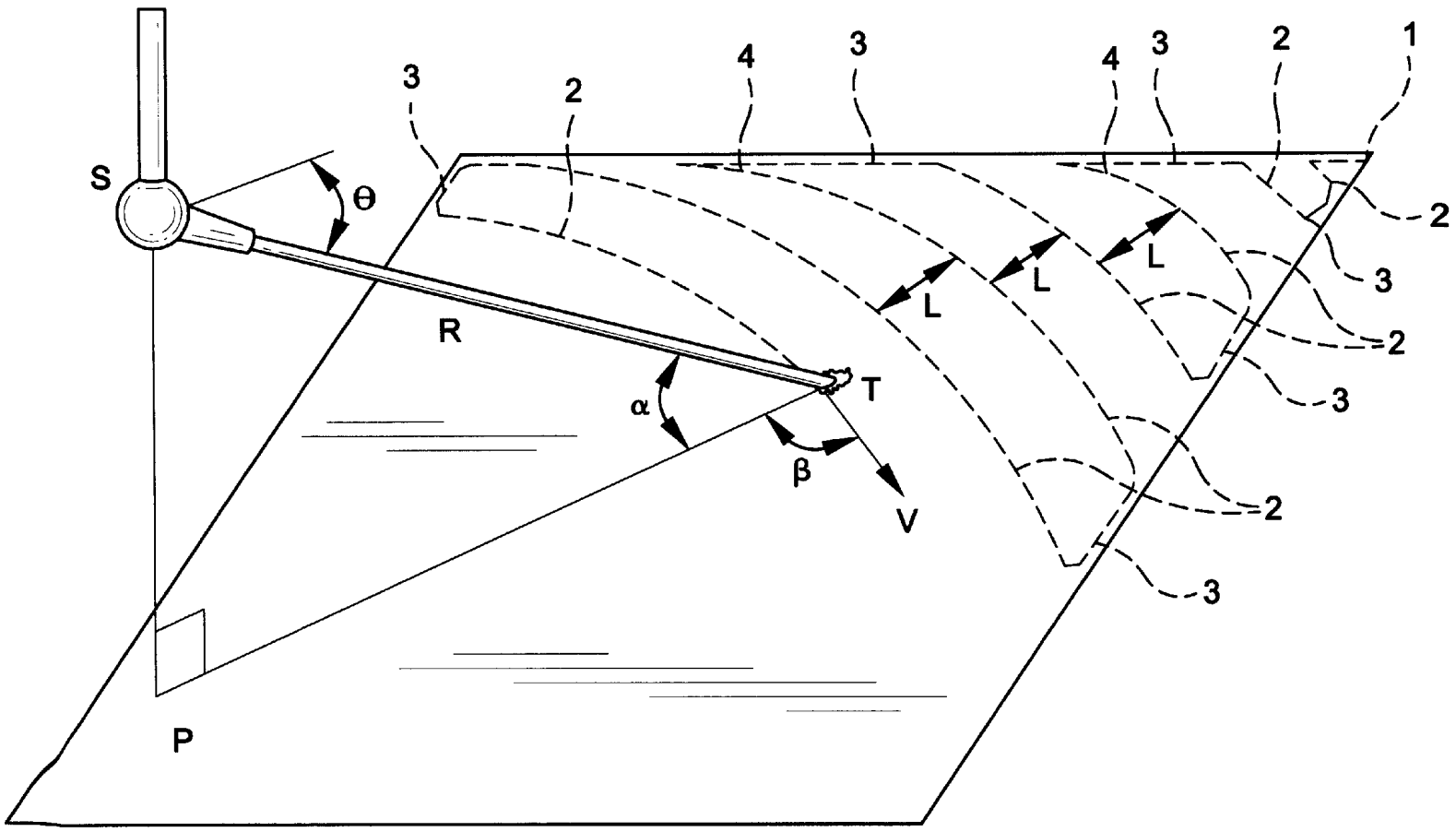
FIG. 5 shows an example of the trajectory made by the impingement point of the liquid jet, as well as some of the parameters used for the definition of the method.

The first main rule for the cleaning process is that all of the surfaces need to be treated with exactly enough intensity. In case of some places being treated with too much intensity, cleaning time and washing fluid are spilled unnecessary, which increases the costs of washing; in case of too little intensity, the surface will not get clean. In general the surfaces will need to be covered by more or less parallel 'tracks'. A track meaning a part of the trajectory followed by the impingement point of the jet over the surface to be cleaned. FIG. 5 illustrates an example of this track-wise cleaning. The trajectory described by the impingement point is plotted as the fat dashed line. In the illustration tracks are understood to be the concentric circular parts of the trajectory. The perpendicular distance between the tracks, denoted with the symbol L, is one of the most important parameters, being bound by some strict rules according to the inventions method.

The connections between the tracks, marked with the number 3, do not contribute significantly to the cleaning, which is why their use should be avoided as much as possible by connecting tracks on the neighbouring surfaces, or by making them with the largest possible speed in the shortest possible time.

The extra parts of the trajectory marked with numbers 1 and 4 originate from the importance of skipping no places during cleaning. In case of 1 this comes from the need of maintaining the trajectory into furthest corner of the trajectory; in case of 4 the sharp edge in the trajectory is maintained a little further than what should be expected considering the desired constancy of the density of tracks.

A distinction has to be made between two kinds of operations that may be performed by the robot in the same washing process, viz. the spreading of a cleaning agent and the removal of pollution. Spreading of an agent intends to leave as much fluid as possible behind on the jet's target surface, whilst the induced flow into the direction of the drain should be as small as possible. In contrast, removal of pollution needs leaving as little fluid as possible staying behind on the surface, whilst the flow to the drain must be as large as possible.

Figure 6:
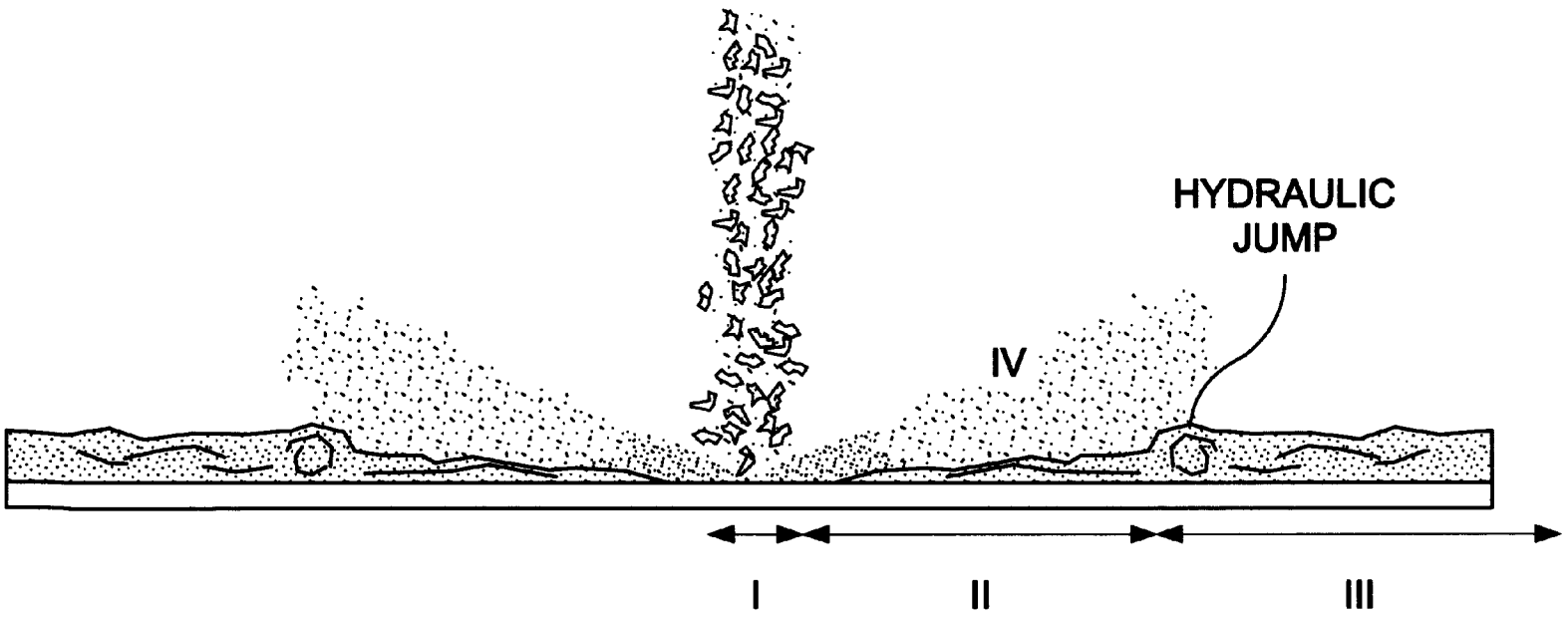
FIG. 6 shows a drawing of the effects occurring when a jet impinges perpendicularly onto a solid surface.

In order to fulfil these demands the invention's method uses several properties of the impinging jet and the running fluid film. FIG. 6 shows a sketch of an impinging jet. In the figure four area's with distinguishable properties are plotted. In the figure I is the direct impingement area, II is the area with radial flow, III is the area where liquid runs under influence of gravity forces and IV is the splashing water.

Under different circumstances these effects influence the choice of track density of the washing pattern and hence the value of L:

ad. I: As soon as the jet has left the nozzle, it breaks up in smaller and larger drops. The hammering effect of the impinging drops has a strong cleaning potential, which on the other hand is confined in a very small area as large as the diameter of the jetting swarm of drops. In case of a very difficult removable pollution, it is in favour of the efficiency to apply a value of L smaller than, or equal to, the diameter of this area.

ad II: The area around the direct impingement area features a liquid film flowing in radial directions away from the impingement point, loosing its energy very rapidly until it reaches the circular border marked with the symbol H in FIG. 6. This is the so-called hydraulic jump, characterised by a sudden increase of water level. The cleaning potential of the radial flow area depends on the exerted shear and hence on the distance to the impingement point. For easier removable kinds of pollution the optimum value of L, has to be a certain fraction of the radius of the radial flow area. The width of the track-wise cleaned area strongly depends on the transversal speed with which the impingement point travels over the surface. The relation between V and L will be dealt with in the text below.

ad. III: Outside of the hydraulic jump the liquid has lost its initial kinetic energy and streams down only under influence of gravity forces. The diameter of the hydraulic jump depends strongly on the surrounding fluid level. Concerning the bottom surface, it is important that a good draining of the fluid is ensured by sufficiently sloping of the bottom. On the vertical walls the hydraulic jump occurs above the impingement point only and is roughly parabolically shaped with the impingement point in the focus. On the down-stream side the radial flow area changes imperceptibly into the gravity controlled area.

The direction in which the liquid flows down has it consequences for the design of the cleaning pattern:

If the washing is done in the top to bottom direction the down-flow will be maximised since the jet adds water in an area where water flow already exists, due to the tracks that were made up-stream. Further the pollution, that has just been mobilised by the jet, does not re-contaminate already cleaned area.

By working from bottom to top the down-stream flow will be minimised, leaving a fluid film that is as homogeneously as possible. This makes this method very suitable for the spreading of a cleaning agent.

ad.IV: Part of the liquid leaves the jet's impingement point as splashing water and therefore does not contribute to the shear in the radial flow area. The cleaning potential of splashing water is very limited. On the other hand may it be used for cleaning the places that can not be reached by the jet directly. For this purpose the jet can be put to a stand-still on a location from which it is known that water will splash into the direction of such a shadow area. It is even possible to add special jet-deflectors in the room, for the purpose of generating splashing water into the shadow area directions. An additional disadvantage is that such a deflector itself usually causes a new shadow area. Reversely it might happen that splashed water re-contaminates already cleaned places. The trajectory followed by the jets impingement point should be designed in accordance with the geometry of the room that this situation is avoided.

Figure 7:
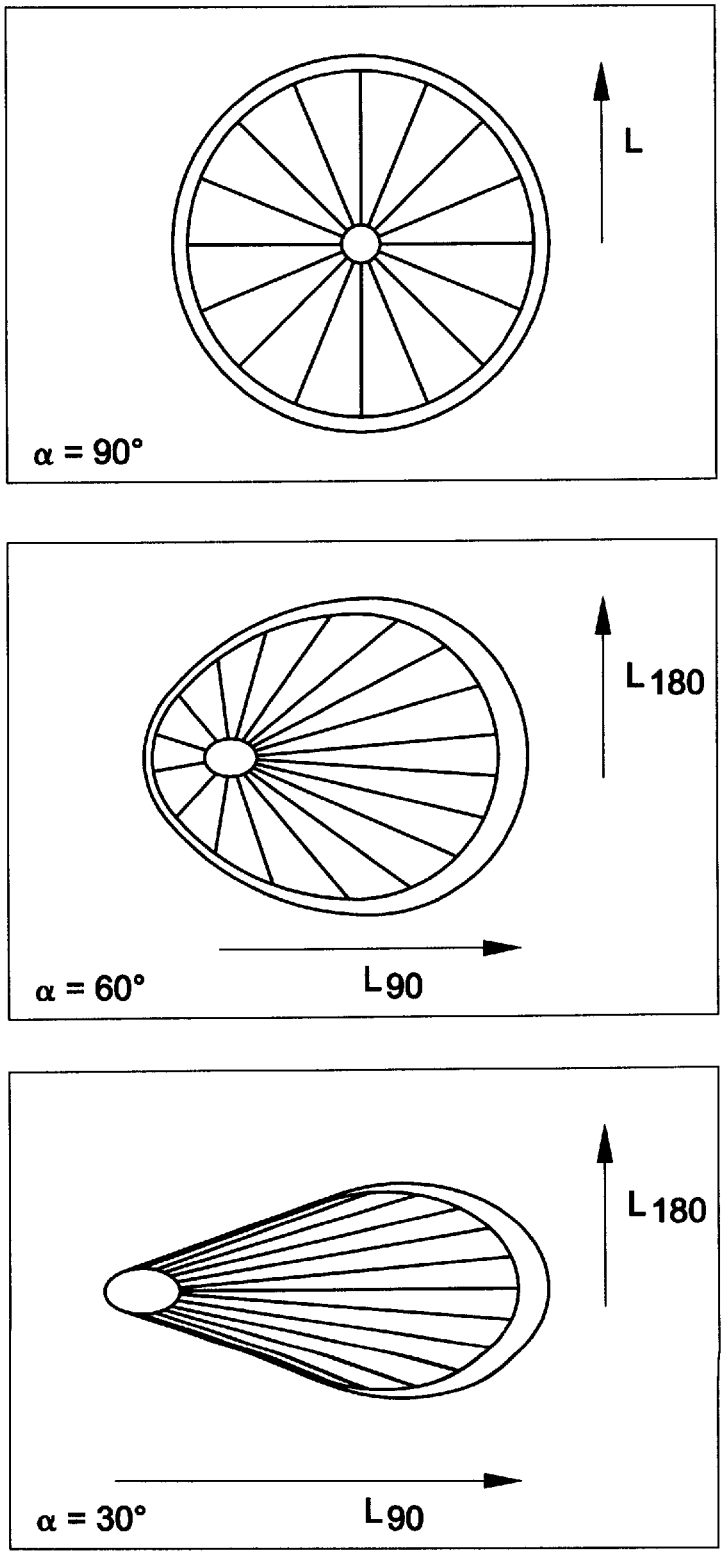
FIG. 7 shows the deformation of the impingement area for a jet impinging perpendicularly and under a number of oblique angles.

In FIG. 6 and in most of the text above it has been assumed that the jet impinges perpendicularly. It should be considered however, that, with exception of a few small places, the jet usually impinges not perpendicularly but obliquely under a certain angle $\alpha$ with the target surface. Depending on the value of $\alpha$ the shape of the impingement area will be deformed and the character of the described effects will be changed. Knowledge of these changes is needed for the further optimisation of the cleaning performance. In FIG. 7 the shape of the impingement area is sketched for three different impingement angles, one of them being perpendicular.

ad. I: The direct impingement area, shown in FIG. 7 as the black spot in each of the three sketches, deforms elliptically, with a short elliptic axis that remains unchanged and a long elliptic axis that is proportional to $1/\sin\alpha$. The hammering effect of the impinging drops decreases drastically for sharper impingement angles, not only due to the effect of being spread over a larger area but also since the speed component of the jet perpendicular to the target surface is smaller.

ad II: The area of radial flow deforms into an egg-shape. For sharper impingement angles the area gets thinner and longer, while the jet's impingement point will be situated further in the sharpest point of the egg. For sharper angles than a certain value of $\alpha$ a transition takes place where the impingement point lies on the border of the egg-shaped area and no radial flow back occurs any more. For smooth unbroken jets this transition takes place theoretically for sharper angles than $\alpha=45°$. Since in practice the drops of the broken jet dissipate more energy at impact, this transition already occurs at blunder angles of $\alpha$ between 50 and 60°.

The width of the area disturbed by the track-wise movement of the impingement point of the oblique impinging jet, depends on the direction in which the impingement point itself is moving. For a more detailed description it is necessary to define a direction coordinate system at the impingement point. The direction $\beta$ is measured in the target plane, originates in the jets impingement point and is the smallest angle with the perpendicular projection line of the jet onto the target plane. FIG. 5 shows $\beta$ as the smallest angle measured between the speed vector V of the jets impingement point over the target surface and the projection line P-T of the jet onto the surface. With respect to the impingement point T, $\beta=0°$ is the projected direction where the water in the jet came from, and $\beta=180°$ is the opposite direction. Directions with $180°<\beta<360°$ are excluded by the definition's word 'smallest' and are equivalent to the value 360—$\beta$.

Figure 8:
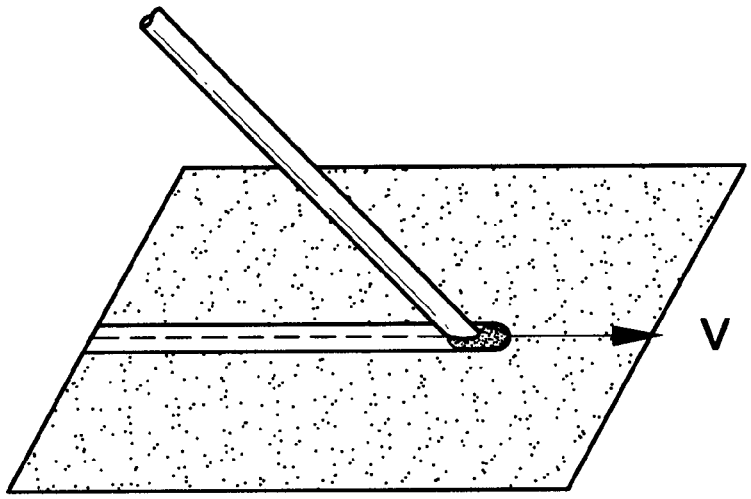
FIG. 8 shows the area cleaned by the jet when the impingement point traverses into direction $\beta=180°$ of the oblique impinging jet.
Figure 9:
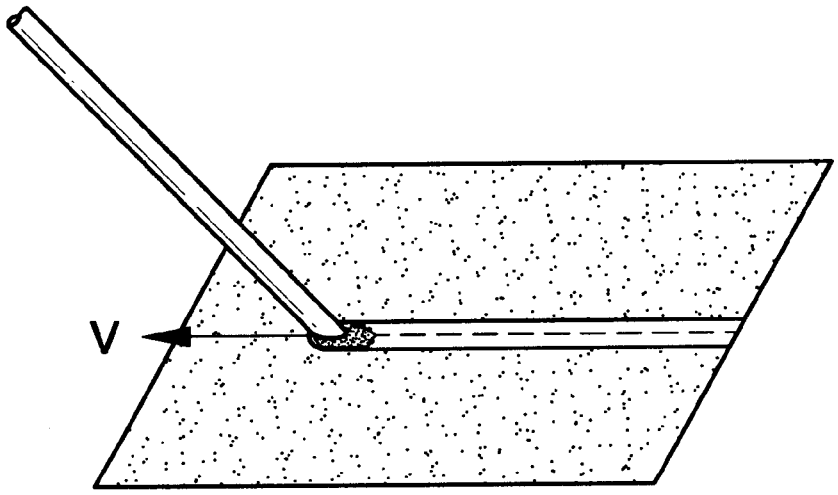
FIG. 9 is the same as as FIG. 8 with traversing angle $\beta=0°$.

The cleaning will be processed at lowest possible costs only if the dirty surfaces are treated with exactly enough intensity. This implies that it should be attempted that all surfaces are wetted as homogeneous as possible. In case of the impingement point traversing along the jets projection line, so either in directions β=180° or β=0° as shown in FIG. 8 and FIG. 9 respectively, a narrow area will be wetted intensively and in case of a traversing direction perpendicular to the projection line, so into one of the directions β=90° as in FIG. 10, a broad area will be wetted with lower intensity. It is favourable for the distribution of a cleaning agent as well as for the removal of contamination when the trajectory of the impingement point is designed in such a way that the traversing direction β equals 90° as much as possible.

Figure 10:
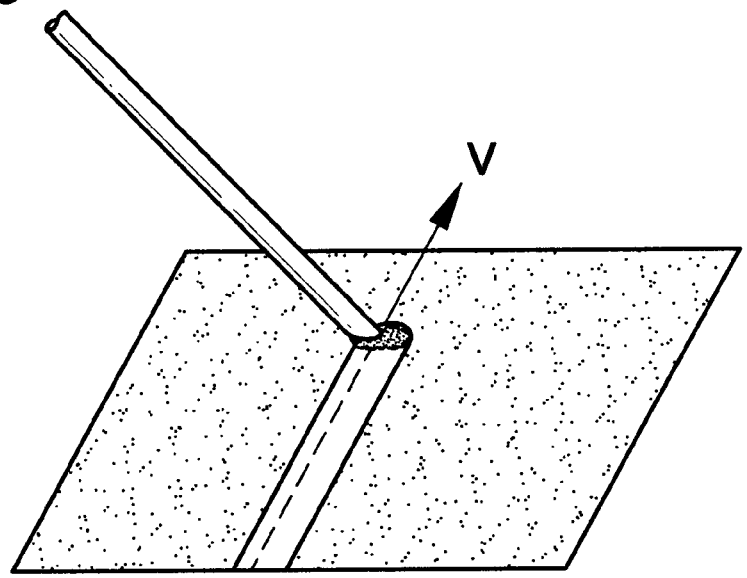
FIG. 10 is the same as FIG. 8 with traversing angle $\beta=90°$.
Figure 11:
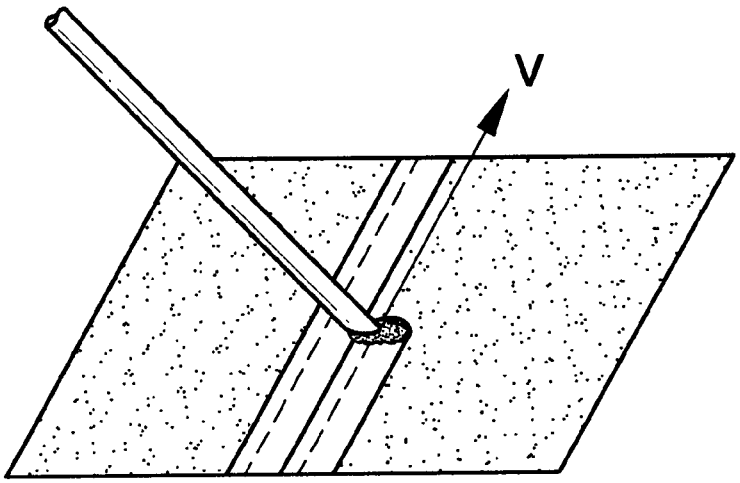
FIG. 11 is the same as FIG. 10 where the second trajectory is being made correctly next to the first.
Figure 12:
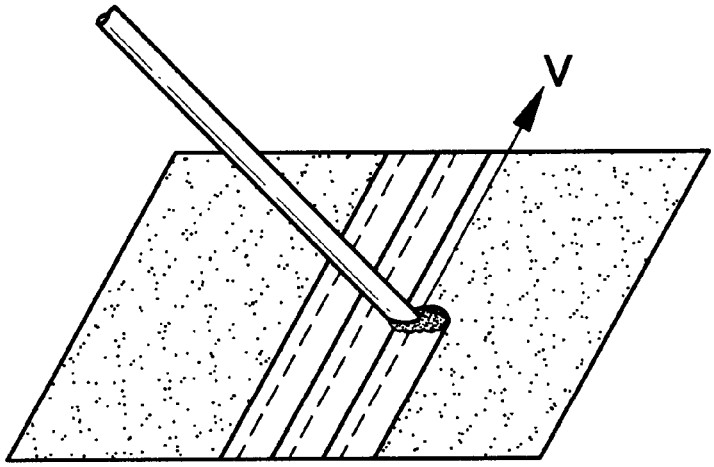
FIG. 12 is the same as FIG. 11 where the third trajectory is being made correctly next to the second.
Figure 13:
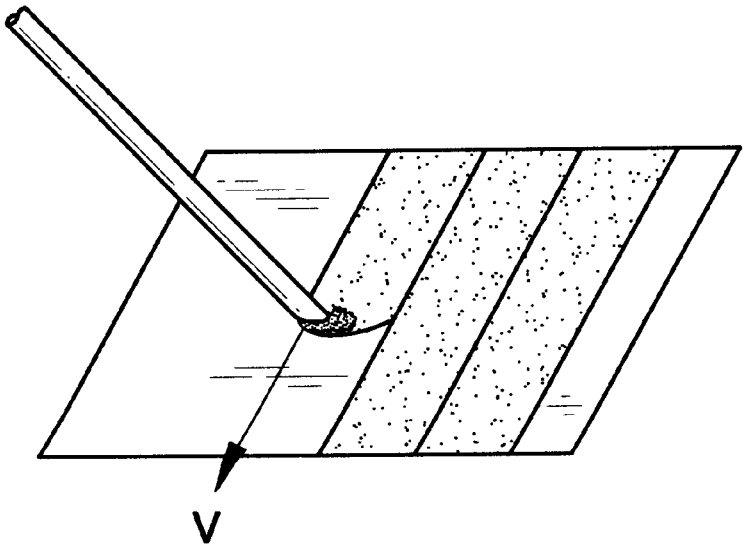
FIG. 13 shows the correct way of distributing a cleaning agent.

This conclusion, that the impingement point of the jet should be traversing into β=90° directions as much as possible, could also have been drawn considering the transport behaviour in the impingement area. FIG. 10 shows that the cleaned area is broader than those in FIG. 8 and FIG. 9. Furthermore the area is situated unsymmetrically around the line followed by the impingement point, since it is broader on the β=180° side. This is also the direction in which most of the dispersed pollution will have been transported. The correct way for cleaning the entire surface systematically is by making tracks always on the β=180° side with respect to the preceding ones. To illustrate this FIG. 11 and FIG. 12 showing the first two tracks following the track of FIG. 10 in such a way that the best possible cleaning effect is obtained. The pollution transported by the first track, is transported further by the second and the third track over a distance as large as possible. The distance between the tracks should be such that the impingement point follows the border of the area cleaned by the preceding track. If the distance becomes too large a trail of pollution will stay behind and the cleaning system is spoiled. Actually the first track of FIG. 10 was made at the wrong location, since it is impossible to clean the area in the drawing on the left hand side of the first track, without re-contaminating previously cleaned places.

It may not always be possible to design the entire cleaning trajectory in such a way that the impingement point follows only the directions β=90°. If the impingement point moves into direction β=0° the dispersed pollution is transported partly sideways and partly to the long end of the impingement area into directions around β=180°. This leaves the middle of the track slightly polluted as in FIG. 9. In case of cleaning a room the traversing directions around β=0° should be avoided.

When the impingement point traverses into direction β=180°, the dispersed pollution is pushed forward in front of the jet and ends up on both sides of the track, as shown in FIG. 8. The pollution is transported largely always perpendicularly to the track. The maximum allowable distance L between the tracks of the cleaning trajectory equals the transportation distance of pollution into the direction of the next planned track. This distance depends on the shape of the radial flow area and, for oblique impingement angles, also on the traversing direction of the jet. The arrows in FIG. 7 show transportation direction and distance of the dispersed pollution in case of the jet traversing into either β=90° or β=180° as marked by the index of L. At perpendicular impingement, the value of L should not be higher than half the diameter of the radial flow area independent of the traversing direction. At oblique impingement, for sharper angles of α, the allowable value of L will be larger for traversing directions β=90° and will be smaller for traversing directions of β=180°.

All of the above mentioned effects result in totally different control demands in case of the machine distributing a cleaning agent. Distribution favours the deposition of a homogeneous film of cleaning agent, being as thick as possible. In order to stay behind on the target surface, the jets fluid should come to a halt, which is expected not to happen within the borders of the radial flow area. In case of α being so sharp, that no return flow into the β=0° direction takes place, no radial flow area exists on this side. It even tends to suck-in fluid that was already there. This might have the result that a previously wetted surface stays behind almost dry, whenever the jet traverses into the wrong direction.

For optimal agent distribution the same requirement exists, that the jet should be traversed into β=90° directions as much as possible. The following order of making of tracks is exactly opposite to the order necessary for the removal of pollution. Only when the respective tracks are being made on the β=0° side of their predecessors, the deposition of an agent layer, being as homogeneous and as thick as possible can be achieved. Traversing directions around β=180° should be avoided at all. If directions 90° <β<180° can not be avoided, one of the next tracks should re-wet part of the trajectory Directions of 0<β<90° are allowed. At traversing direction β=0° the allowable distance L between tracks is approximately twice the distance applied for removal.

In case of removing pollution, a connection exists between the traversing speed of the jet's impingement point and the broadness of the cleaned area. Whenever the jet is brought to a stop, in the end the pollution in the impingement area is transported to the border of the radial flow area. Since the jet has to traverse in order to clean the entire surface, the pollution is being transported during the passage of the jets impingement area for a short time only. The faster the jet is moving, the shorter this passage time and the smaller the transportation distance.

For the broadness, B, of the cleaned area as a function of the traversing speed, V, of the jets impingement point at perpendicular impingement the following empirical relation exists:

$$\frac{B}{B_0} = 1 - \frac{V}{V_0} \tag{1}$$

where $V_0$ en $B_0$ are experimentally determinable constants.

For the determination of $V_0$ a few test tracks have to be made with increasing traversing speed.

$V_0$ is the value of the traversing speed V, for which the broadness of the cleaned area becomes zero.

The value of $B_0$ equals the broadness of the cleaned area when the jet traverses with a very low speed.

The choice of traversing speed V affects the costs of cleaning of the entire room. In case of the speed being too high, the cleaning will be insufficient, in case of this speed being too low, it will take too much time before the entire surface has been treated. Somewhere in between a speed exists for which a maximised amount of surface per unit of time will be cleaned, and hence for which the cleaning costs are minimised. Since the cleaned amount of area per unit of time is proportional to B times V, with help of equation 1 it can be shown that the optimum cleaning speed obeys:

$$V = \frac{1}{2} V_0 \tag{2}$$

and the corresponding broadness of the cleaned area $$B = \frac{1}{2}B_0 \tag{3}$$

For the small area on the surface where perpendicular impingement exists the above values can be used as guideline, whereas for the distance L between the systematically deposited tracks it holds that $$L = \frac{1}{4}B_0 \tag{4}$$

As was shown above the advisable distance L is not a constant, but depends on the impingement angle and the traversing direction of the jet. For sharp impingement angles and a large values of L the traversing speed should be much smaller, since the pollution has to be transported over a longer distance, and since the width of the impingement area measured in the traversing direction will be smaller, which shortens the available transport time during a passage of the jet's impingement point.

A very good solution for this problem can be found by assuming that the entire surface should be treated with the same intensity. This leads to the simple connection between traversing speed and track distance:

$$VL=C \tag{5}$$

where C is a constant.

In most cases the parts of the treated surface targeted under the sharpest impingement angles correspond to the locations situated at the longest distance in space. At larger distance the air resistance of the jet increases strongly whenever it traverses too fast. A lucky advantage of the method of equation 5, is that a lower traversing speed was already prescribed, due to the longer allowed value of L whenever the impingement point moves into the $\beta=90°$ direction.

The needed value of C depends amongst others on the kind of pollution, the amount of pollution, the material that the surface to be cleaned is made of and the applied cleaning method.

For the purpose of distributing a cleaning agent the value of C follows from the desired thickness, $\delta$, of the layer and the volume flow rate, $\phi$, of the liquid in the jet:

$$C = \frac{\phi}{\delta} \tag{6}$$

For the purpose of removing pollution the value of the constant obeys $$C = \frac{1}{8}V_0B_0 \tag{7}$$

A method that works even better is by determining the value of C experimentally by means of washing tests. A good method could be to try determining the needed amount of washing liquid per square meter for which the surface is sufficiently cleaned. This needed amount of fluid translates into a value of $\delta$, for which equation 6 gives the correct value of C.

On the one hand, the method of equation 5 is very sensitive for the correct value of C: a too high value means insufficient cleaning and a too low value means unnecessarily high cleaning costs. On the other hand the method is rather insensitive for the ratio of V and L, meaning that quite some room for variation in one of the parameters is allowed given that this is compensated by the other parameter. It is for this reason unnecessary to know the exact dimension and deformation data of the impingement area; It is sufficient to make a rough estimation of the dimensions and accompanying values of L.

By combining all of the elements in the method above a few examples can be deduced of the implicated optimised pattern for a complete room. Characteristic for the pattern needed for distributing a cleaning agent is that roughly the same pattern has to be followed as is necessary for the removal of pollution, differing in the fact that it is made in reversed direction and following order. Further the distance L between the tracks and the traversing speed V are allowed to be larger in case of distributing an agent. The following order for distribution of the different surfaces is in general starting at the bottom, next the vertical walls and next the ceiling or top surface; for removal of pollution the following order is reversed.

For horizontal non curved surfaces as the plane bottom or the plane top of a tank, the best trajectory is a spiral, like that of a watch, around the perpendicular projection point of the head of the robot onto the surface. In case of distribution the spiral works towards the centre, in case of removal it works from the centre away. The distance between the windings increases a little when they are situated more on the outside, whereas the corresponding traversing speed of the impingement point goes down proportionally.

In case of the projection point, P, not being in the middle of the surface, or whenever the windings of the spiral reaching the edges, the pattern may cover the rest of the surface with concentric circular segment tracks. FIG. 5 shows an example of this. Since the logistic following order in this example works towards the projection point, p, of the head of the machine onto the surface, the shown pattern is fit for spreading a cleaning agent and not for the removal of pollution.

Figure 14:
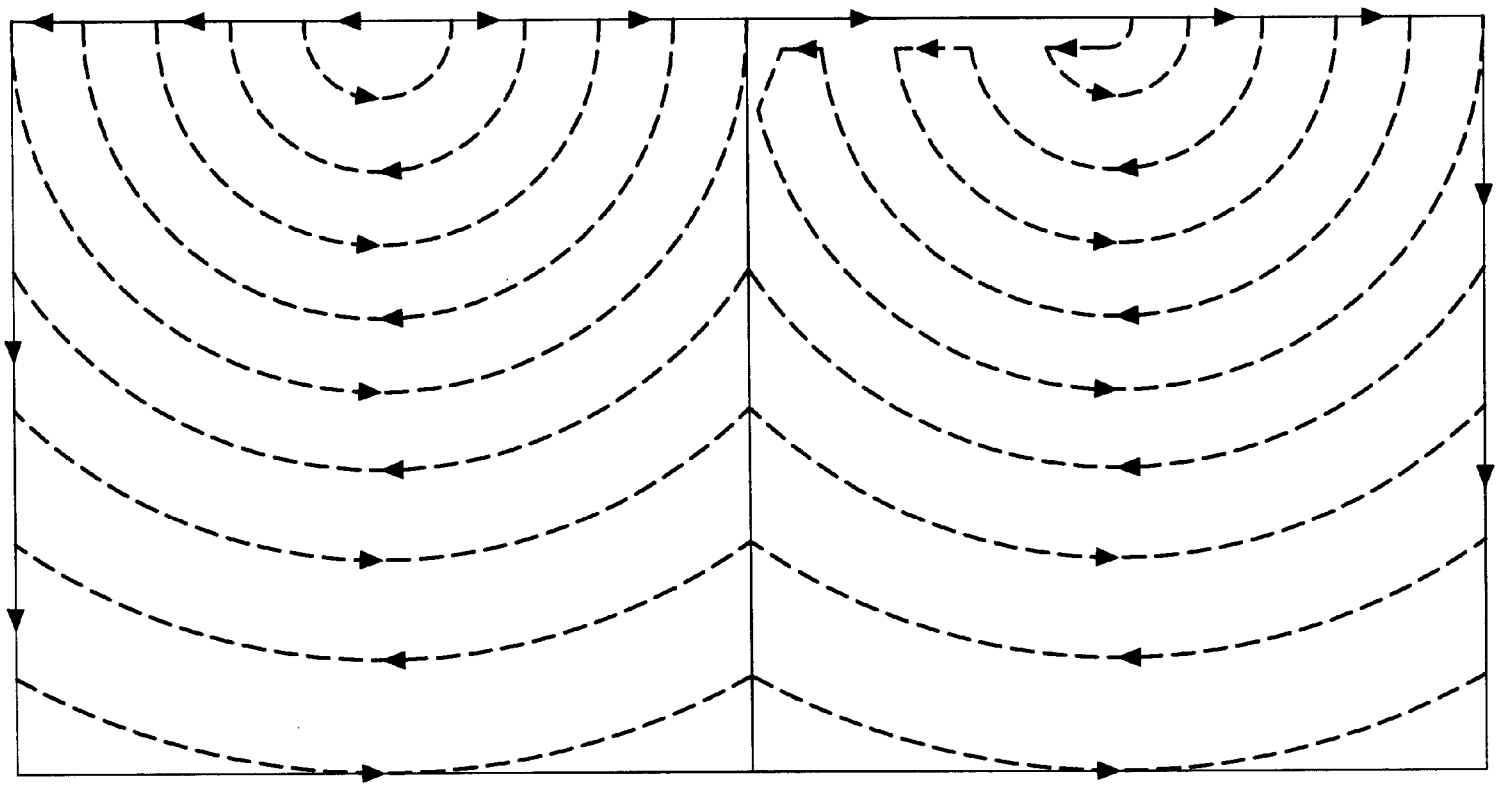
FIG. 14 shows an example of the cleaning trajectory over two of the vertical walls of a cubical tank.

In general for the cleaning of vertical walls the value of C is allowed to be larger than what is the case for horizontal surfaces. In case of the wall being part of a vertical cylinder, the best pattern is a screwed spiral, working bottom to top for spreading an agent, and working top to bottom for removing pollution. In case of the vertical wall being a plane part of a rectangular room, the best trajectory translates again into concentric circle segments made in a zig-zagging movement. FIG. 14 shows in plane projection the ideal trajectory over two of the vertical walls of a cubical shaped room. It was assumed that the machine was located in central position as high as possible. The design of the trajectory meets the demand that no water should be splashing into areas that were already cleaned. Further the running through of the pattern over the two surfaces saves on the needed amount of connecting pieces between the circular tracks.

Comparing the method of the invention to existing methods of conventional cleaning apparatus, it should be remarked that the spiral shaped cleaning trajectory already exists. There is even literature about a machine that had the possibility of changing the rotation speed in such a way that a larger cleaning intensity can be achieved on the furthest situated places (U.S. Pat. No. 3,874,594). Although such modifications raise the cleaning efficiency somewhat compared to other competitive models, none of these machines comes even close to the efficiency that can be achieved with the invention. Most of the conventional machines make homogeneous rotational movements about both of the rotation axes. This implies that the distance between the tracks increases much more than what is needed according to described method above. Furthermore the transversal speed increases with the distance from the machine, whilst on grounds of oblique jet impingement it should be decreasing.

It is possible to estimate theoretically what the efficiency improvement will be when a conventional machine is replaced by a properly programmed robot according to the invention. It is necessary to know where on the surface to be cleaned the bottle-neck area will be in case of the cleaning being processed with a conventional machine. Assuming that the pollution is spread homogeneously over the entire surface and that there are no places where the pollution has a more rigid consistency, the bottle-neck area will be the place in the tank where the conventional machine deposits the smallest amount of washing water per square meter. An estimation of the improvement needs the following two axioms:

A room is considered clean only when it is entirely clean.

Whenever in the end the bottle-neck area is cleaned using a certain cleaning intensity, the rest of the surface could have been cleaned with the same intensity.

The first axiom implies that the washing process is maintained until the bottle-neck area is clean. The second axiom describes in essence why the invention has a so much better cleaning efficiency. By dosing the amount of washing water at all places in exactly the right quantity the optimum cleaning efficiency is achieved.

For conventional machines, meeting the property that the nozzles make homogeneous rotational movements about the two perpendicular axes, the cleaning intensity obeys the following equation:

$$I_{conv} = \frac{\sin\alpha}{2\pi^2 R^2 \cos\theta} \tag{8}$$

where $I_{conv}$ is the cleaning intensity of the conventional machine

R the distance of the machine to the target surface [m]

θ the angle between jetting direction and the horizontal plane [°]

The equation shows, by means of the cos θ term, the negative effect of the jetting direction twice being vertical during every rotation of the nozzles, targeting the same small locations above and below the machine. Multiplication of $I_{conv}$ by the volume flow rate of the machine and the duration of the washing process, yields the locally deposited amount of washing water per square meter.

The cleaning intensity I is best described as a sort of statistic parameter, a chance per area. The total chance equals 1, after all the machine always has a spraying direction. This means that the cleaning intensity for the invention can be estimated too. Since the robot will be programmed for the shape of the room that it is installed in, in such a way that all places in need of cleaning receive the same amount of cleaning intensity, it follows that:

$$I_{robot} = \frac{1}{A} \tag{9}$$

where $I_{robot}$ equals the cleaning intensity of the invention and

A the total area of the surface to be cleaned [$m^2$]

The location on the surface where $I_{conv}$ has the lowest value will be the worst cleaned place and forms for the conventional machine the cleaning bottle-neck. Suppose this value equals $I_{min}$. Now the cleaning efficiency η can be defined as:

$$\eta = \frac{I_{\min}}{I_{\text{robot}}} 100\,\% = A I_{\min} 100\,\% \tag{10}$$

The value of η expresses the improvement of the washing process that can be achieved when the invention replaces a conventional machine. Suppose this value equals 10%, this implies that from that moment on the cleaning time, the use of water and energy, and the quantity of washing water residue all exceed 10% of their normal values.

The value of η strongly depends on the shape of the tank and the location of the machine. For vertical and for horizontal tanks this value can be found with FIG. 15. The cleaning efficiency has been calculated as a function of the length/diameter ratio, L/D, of the tank and for 5 locations of the machine in the tank. Small values of L/D correspond to flat disk shaped tanks, such as the land based floating roof tanks used for storage of oil products or chemicals. Large values of L/D correspond to a pipe shaped tanks. The more extreme the shape of the tank and the more the machine is located out of centre, the larger the achievable improvement will be. The horizontal pipe shaped tanks are even more difficult than the vertical ones.

Figure 15:
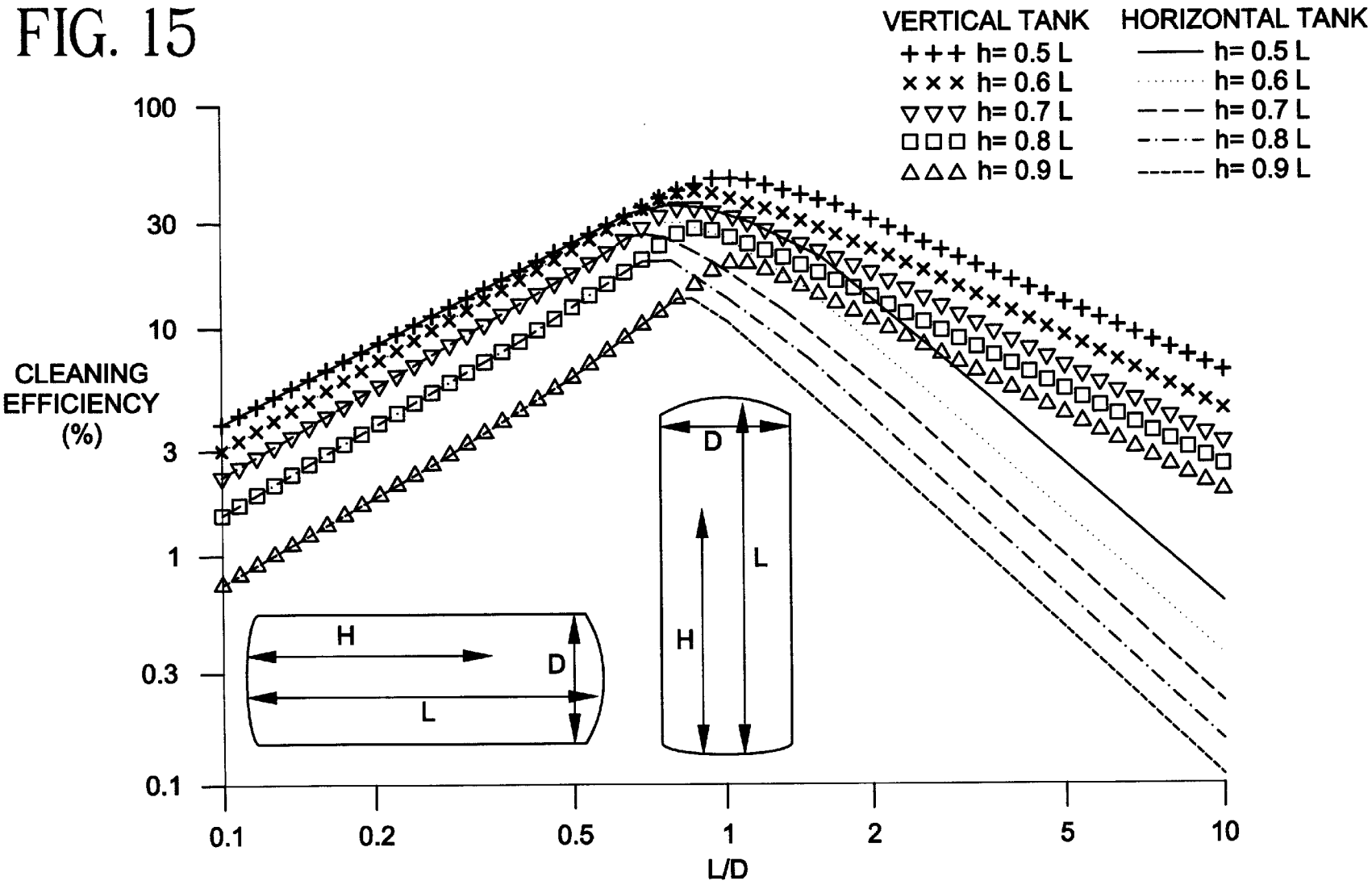
FIG. 15 shows a graph of the obtainable benefit by replacing a conventional tank cleaning machine by the invention.

In principle the calculation of η can be made for very room to be cleaned, but displaying them similarly as in FIG. 15 is to complicated for other spatial shapes, due to the larger number of parameters.

Although the predicted improvements are already spectacular, in practice the savings proved to be even higher. In the calculation of the cleaning efficiency no account was taken in consideration of washing from top to bottom, the exact linking up of cleaned track areas, the pushing away of pollution in one direction and possibly the presence of area's that need more thorough cleaning or maybe no cleaning at all. Furthermore since robot has no undefined pre-rotation, as is the case with conventional machines, the washing process is always exactly reproducible.

I claim:

1. Apparatus for cleaning the interior surfaces of an enclosure, comprising at least one nozzle, a supply channel for providing flow communication between a source of cleaning fluid and said at least one nozzle, first drive means coupled to said at least one nozzle for rotating said at least one nozzle about a first axis, second drive means coupled to said at least one nozzle for rotating said at least one nozzle about a second axis different than said first axis, said first drive means being separate from said second drive means such that rotation of said at least one nozzle about each of the first and second axes is decoupled from rotation of said at least one nozzle about the other of the first and second axes, and control means coupled to said first and second drive means for independently controlling said first and second drive means such that said at least one nozzle is rotatable about each of the first and second axes independent of rotation of said at least one nozzle about the other of the first and second axes.

2. The apparatus of claim 1, wherein said control means comprise a computer and electronic components interposed between said computer and said first and second drive means.

3. The apparatus of claim 1, wherein said first and second drive means are structured and arranged such that said at least one nozzle is rotatable about the first axis via said first drive means while said second drive means do not rotate said at least one nozzle about the second axis and rotatable about the second axis via said second drive means while said first drive means do not rotate said at least one nozzle about the first axis.

4. The apparatus of claim 1, wherein said control means are structured and arranged to control rotation of said at least one nozzle such that a trajectory described by an impingement point of a jet emerging from said at least one nozzle defines substantially parallel tracks.

5. The apparatus of claim 1, wherein said control means are structured and arranged to control rotation of said at least one nozzle such that a trajectory described by an impingement point of a jet emerging from said at least one nozzle defines a plurality of tracks spaced apart by a common distance.

6. The apparatus of claim 1, wherein said first drive means comprise a first elongate element rotatable about the first axis, a head coupled to and rotating with said first elongate element about the first axis, and a first gear mounted for rotation along with said head about the first axis; and said second drive means comprise a second elongate element rotatable about the second axis, a second gear coupled to and rotating with said second elongate element about the second axis and in toothed engagement with said first gear.

7. The apparatus of claim 6, wherein said first and second elongate elements are concentric.

8. The apparatus of claim 6, wherein said first elongate element is a bar and said second elongate element is a tube arranged around said bar.

9. The apparatus of claim 6, wherein said first elongate element is a tube and said second elongate element is a bar arranged in an interior of said tube.

10. The apparatus of claim 6, wherein said first and second elongate elements are rotatable at different rates of rotation to thereby vary the rotational position of said at least one nozzle.

11. The apparatus of claim 6, wherein said first drive means further comprise a first motor and a transmission member for transferring motive power from said first motor to said first elongate element to cause rotation of said first elongate element, and said second drive means further comprise a second motor and a second transmission member for transferring motive power from said second motor to said second elongate element to cause rotation of said second elongate element.

12. The apparatus of claim 11, wherein said control means are arranged to control said first and second motors.

13. The apparatus of claim 1, wherein said at least one nozzle comprises a plurality of nozzles, said first drive means comprise a first elongate element rotatable about the first axis, a head coupled to and rotating with said first elongate element about the first axis, and a plurality of first gears each mounted for rotation along with said head about the first axis and connected to a respective one of said nozzles; and said second drive means comprise a second elongate element rotatable about the second axis, a second gear coupled to and rotating with said second elongate element about the second axis and in toothed engagement with each of said plurality of first gears.

14. The apparatus of claim 1, wherein said first drive means comprise a first elongate element rotatable about the first axis and including a cog-rail and said second drive means comprise a second elongate element movable in a longitudinal direction relative to said first elongate element and a gear rotatable about the second axis and in toothed engagement with said cog-rail such that said second elongate element is arranged to translate in a direction of the first axis to thereby determine, by means of a transmission ratio of said cog-rail and said gear, the rotational position of said at least one nozzle about the second axis.

15. Method for cleaning the interior surfaces of an enclosure, comprising supplying cleaning fluid to at least one nozzle, rotating said at least one nozzle about a first axis via first drive means, rotating said at least one nozzle about a second axis different than said first axis via second drive means, said first drive means being separate from said second drive means such that rotation of said at least one nozzle about each of the first and second axes is decoupled from rotation of said at least one nozzle about the other of the first and second axes, and independently controlling rotation of said at least one nozzle about the first axis via said first drive means and about the second axis via said second drive means such that said at least one nozzle is rotatable about each of the first and second axes independent of rotation of said at least one nozzle about the other of the first and second axes.

16. The method of claim 15, further comprising the step of:

measuring pressure, temperature or flow rate of the cleaning fluid.

17. The method of claim 15, wherein the step of controlling rotation of said at least one nozzle comprises the step of controlling said first and second drive means such that a trajectory described by an impingement point of a jet emerging from said at least one nozzle defines substantially parallel tracks.

18. The method of claim 15, wherein the step of controlling rotation of said at least one nozzle comprises the step of controlling said first and second drive means such that a trajectory described by an impingement point of a jet emerging from said at least one nozzle defines a plurality of tracks spaced apart by a common distance.

19. The method of claim 15, wherein the step of controlling rotation of said at least one nozzle comprises the step of controlling said first and second drive means such that an impingement point of a jet emerging from said at least one nozzle moves in a direction substantially perpendicular to a heart line of the jet.

20. The method of claim 15, wherein the step of controlling rotation of said at least one nozzle comprises the step of controlling said first and second drive means such that tracks are defined by an impingement point of a jet emerging from said at least one nozzle and each track is closer to said at least one nozzle than preceding tracks.

21. The method of claim 15, wherein the step of controlling rotation of said at least one nozzle comprises the step of controlling said first and second drive means such that tracks are defined by an impingement point of a jet emerging from said at least one nozzle and each track is farther from said at least one nozzle than preceding tracks.

* * * * *